US006668764B1

(12) United States Patent
Henderson et al.

(10) Patent No.: US 6,668,764 B1
(45) Date of Patent: Dec. 30, 2003

(54) COOLING SYSTEM FOR A DIESEL ENGINE

(75) Inventors: Noel Henderson, Chipping Ongar (GB); Chris Bush, West Chiltington (GB); Steven Joyce, Redhill (GB); Iain Gouldson, Billericay (GB)

(73) Assignee: Visteon Global Techologies, Inc., Dearborn, MI (US)

( * ) Notice: Subject to any disclaimer, the term of this patent is extended or adjusted under 35 U.S.C. 154(b) by 7 days.

(21) Appl. No.: 10/207,335

(22) Filed: Jul. 29, 2002

(51) Int. Cl.[7] ..... F01P 3/00
(52) U.S. Cl. ..... 123/41.29; 123/41.1; 123/41.33
(58) Field of Search ..... 123/41.1, 41.29, 123/41.33

(56) References Cited

U.S. PATENT DOCUMENTS

| | | | |
|---|---|---|---|
| 4,337,733 | A | 7/1982 | Hirata et al. |
| 4,549,505 | A | 10/1985 | Hirano et al. |
| 4,624,221 | A | 11/1986 | Fujigaya et al. |
| 4,658,766 | A | 4/1987 | Hirano |
| 4,785,874 | A | 11/1988 | Avrea |
| 5,561,243 | A | 10/1996 | Machida |
| 5,619,957 | A | 4/1997 | Michels |
| 5,836,269 | A | 11/1998 | Schneider |
| 5,868,105 | A | 2/1999 | Evans |
| 6,032,618 | A | 3/2000 | Ferrari et al. |
| 6,109,219 | A | 8/2000 | Sano |
| 6,135,067 | A | 10/2000 | Klamm et al. |
| 6,223,700 | B1 | 5/2001 | Sano et al. |
| 6,340,006 | B1 | 1/2002 | Malatto et al. |
| 6,374,780 | B1 | 4/2002 | Rutyna et al. |
| 2001/0020452 | A1 | 9/2001 | Suzuki et al. |

*Primary Examiner*—Noah P. Kamen
(74) *Attorney, Agent, or Firm*—MacMillan, Sobanski & Todd LLC

(57) ABSTRACT

An engine cooling system and method applicable to a diesel engine in a vehicle. A control module, via a single multi-port valve, controls the coolant flow through a radiator, heater and oil cooler based upon engine operating conditions.

20 Claims, 4 Drawing Sheets

| Operating Conditions | | | | Component Flows | | | Valve Mode |
|---|---|---|---|---|---|---|---|
| Ambient Temp. | Coolant Temp. | Engine Speed | Engine Load | Radiator | Heater | Oil Cooler | |
| Cold | Cold | Low | Low | Off | On | On<br>Off | 1<br>2 |
| Cold | Hot | Low | Low | On<br>Off | On | On | 3<br>1 |
| Hot | Cold | Low | Low | On | Off | On | 4 |
| Hot | Hot | Low | Low | On | Off | On | 4 |
| Cold | Cold | High | High | On | On | On | 3 |
| Cold | Hot | High | High | On | On | On | 3 |
| Hot | Cold | High | High | On | Off | On | 4 |
| Hot | Hot | High | High | On | Off | On | 4 |

Fig. 2

| Operating Conditions | | Component Flows | | | Valve Mode |
|---|---|---|---|---|---|
| Ambient Temp. | Oil Warming | Radiator | Heater | Oil Cooler | |
| Hot | Yes | Off | Off | On | 5 |
| Cold | Yes | Off | On | On | 1 |
| Hot | No | Off | Off | Off | 6 |
| Cold | No | Off | On | Off | 2 |

Fig. 3

| Valve Mode | Coolant Flow | | |
|---|---|---|---|
| | Radiator | Heater | Oil Cooler |
| 1 | Off | On | On |
| 2 | Off | On | Off |
| 3 | On | On | On |
| 4 | On | Off | On |
| 5 | Off | Off | On |
| 6 | Off | Off | Off |

Fig. 4

COOLING SYSTEM FOR A DIESEL ENGINE

BACKGROUND OF INVENTION

The present invention relates to a cooling system and method for thermal management of an engine in a vehicle, and more particularly to a diesel engine in a vehicle.

Conventionally, a cooling system for a diesel engine in a vehicle includes a water pump, for pumping a liquid coolant through the system, a radiator for cooling the coolant, and an oil cooler for cooling oil used by the engine. A fan is also typically provided to draw air through the radiator in order to enhance the cooling effect of the radiator. The coolant is also typically routed through a heater core in order to provide heat for the vehicle passenger compartment, when needed, as well as being routed through an exhaust gas recirculation (EGR) cooler.

The water pump and the fan are typically driven off of the engine crankshaft, so their speed is strictly a function of the engine speed. Consequently, when the engine is started cold, a pair of thermostats, one upstream of the radiator and one upstream of the oil cooler, are needed to block the flow through the radiator and oil cooler, respectively, in order to maintain as much heat in the system as possible until the coolant and oil have heated up to their respective operating temperatures. As each comes up to temperature, its thermostat opens and the flow continues strictly as a function of engine speed. But the routing of the coolant and the amount of coolant flow are not a function of any other vehicle or engine parameters that are important to maintaining the desired engine temperature. Moreover, there is a relatively large number of components employed to create this cooling system with limited ability to accurately control the engine temperature.

Thus, it is desirable to have a diesel engine cooling system that overcomes the drawbacks of conventional engine cooling systems. In particular, it is desirable to have a system with the ability to more accurately provide the desired engine coolant and oil cooling, while minimizing the number of components required for the system.

SUMMARY OF INVENTION

In its embodiments, the present invention contemplates a cooling system for a diesel engine, having a coolant inlet and a coolant outlet, in a vehicle. The cooling system has a coolant circuit adapted to operatively engage the coolant inlet and coolant outlet, and a pump operatively engaging the coolant circuit to pump a coolant therethrough. The cooling system also includes a radiator operatively engaging the coolant circuit, an oil cooler operatively engaging the coolant circuit, and a heater operatively engaging the coolant circuit. A valve has a first valve port adapted for receiving coolant from the engine, a second valve port for selectively receiving coolant from the oil cooler, a third valve port for selectively routing coolant to the radiator, and a fourth valve port for selectively routing coolant to the heater, and with the valve being controllable to selectively control the routing of the coolant through the valve ports. The cooling system also has a control module electrically coupled to the valve for electronically controlling the valve to thereby control the routing of the coolant through the valve ports.

The present invention further contemplates a method of controlling an engine temperature of a diesel engine in a vehicle, with the diesel engine having a coolant circuit including a water pump, a flow control valve, and a radiator, an oil cooler, and a heater each operatively connected to the flow control valve, the method comprising the steps of: detecting a plurality of operating conditions; determining if the operating conditions are within a first mode, a second mode, a third mode, a fourth mode, a fifth mode, or a sixth mode of operation; adjusting the flow control valve to substantially prevent routing of coolant through the radiator and allow for routing of coolant through the heater and the oil cooler if the operating conditions are in the first mode; adjusting the flow control valve to substantially prevent routing of coolant through the radiator and the oil cooler and allow for routing of coolant through the heater if the operating conditions are in the second mode; adjusting the flow control valve to allow for routing of coolant through the radiator, the heater and the oil cooler if the operating conditions are in the third mode; adjusting the flow control valve to substantially prevent routing of coolant through the heater and allow for routing of coolant through the radiator and the oil cooler if the operating conditions are in the fourth mode; adjusting the flow control valve to substantially prevent routing of coolant through the radiator and the heater and allow for routing of coolant through the oil cooler if the operating conditions are in the fifth mode; and adjusting the flow control valve to substantially prevent routing of coolant through the radiator, the heater and the oil cooler if the operating conditions are in the sixth mode.

An advantage of the present invention is that there is a smaller number of components used in the diesel engine cooling system as compared to a conventional system. A single valve selectively controls the amount of coolant flow if any through the radiator, oil cooler and other heat exchangers.

Another advantage of the present invention is that the amount of coolant flowing through the radiator can be more precisely controlled, thus allowing for more accurate control of the coolant temperature, and hence, engine temperature.

A further advantage of the present invention is that the amount of coolant provided to the oil cooler can be controlled, thus allowing for more accurate control of the oil temperature.

BRIEF DESCRIPTION OF DRAWINGS

FIG. 2 is a table illustrating operating conditions and corresponding opening/closing of different valve ports that occur after engine warm-up;

FIG. 3 is a table illustrating operating conditions and corresponding opening/closing of different valve ports that occur during engine warm-up;

FIG. 4 is a table illustrating coolant flow paths for six modes of valve operation.

DETAILED DESCRIPTION

Figure 1:
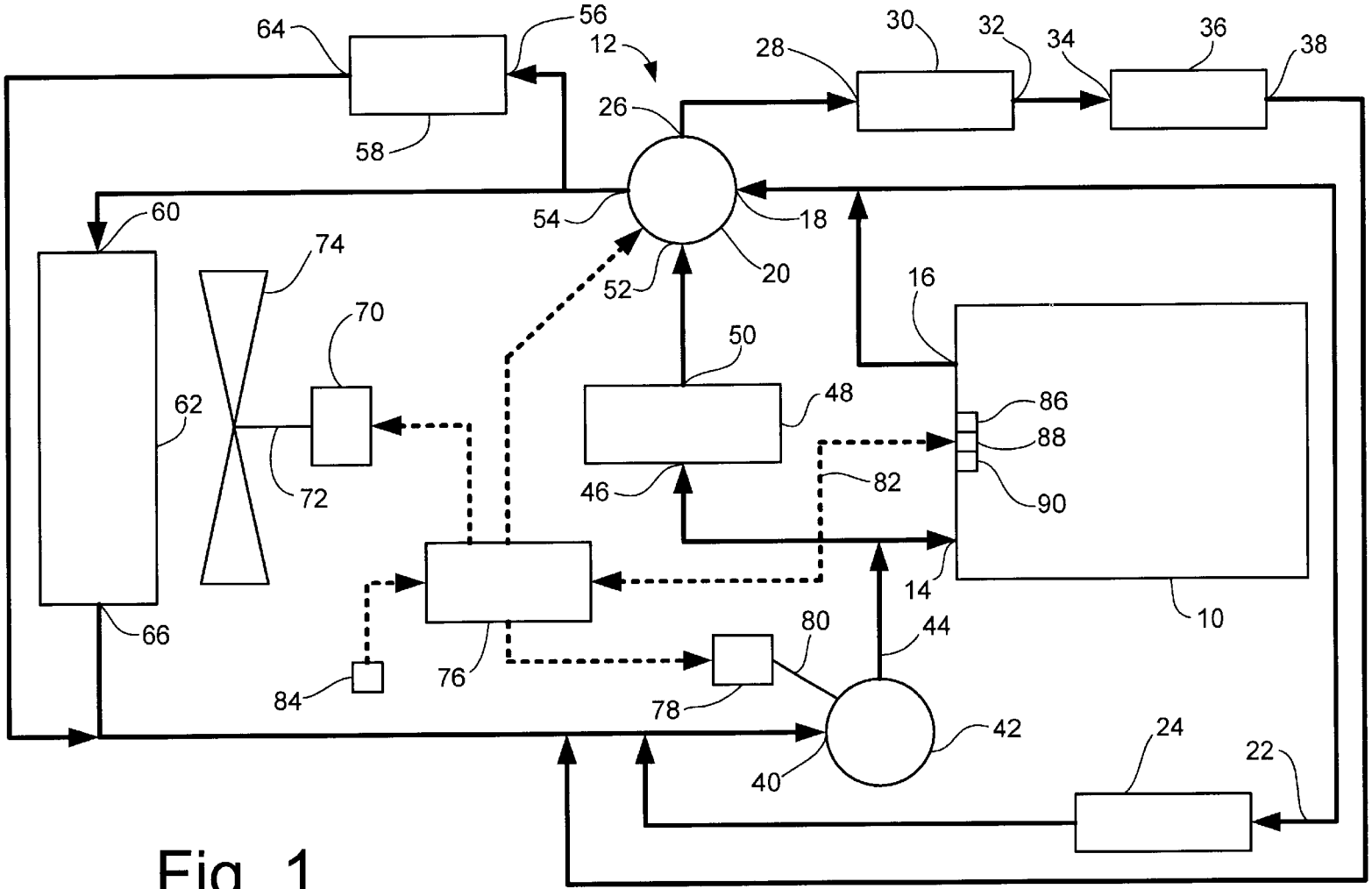
FIG. 1 is a schematic drawing of a diesel engine and engine cooling system in accordance with the present invention.

FIG. 1 illustrates a diesel engine 10 connected to an engine cooling circuit 12. The engine 10 includes a coolant inlet 14 and a coolant outlet 16. The coolant flow paths are illustrated in FIG. 1 with thick lines, and arrow heads indicating the direction of coolant flow in the lines. The coolant outlet 16 connects to a first inlet 18 on a multi-port valve 20, and to an exhaust gas recirculation (EGR) cooler inlet 22 on an EGR cooler 24. A first outlet 26 from the valve 20 leads to an inlet 28 on an auxiliary heater 30, which has an outlet 32 that leads to an inlet 34 on a heater 36, which, in turn, has an outlet 38 that leads to an inlet 40 on a water pump 42. An outlet 44 of the water pump 42 then connects to the coolant inlet 14 of the engine 10. The outlet 44 of the water pump 42 also connects to an inlet 46 of an oil cooler 48. The oil cooler 48 includes an outlet 50 that connects to a second inlet 52 on the valve 20. The multi-port valve 20 also has a second outlet 54 that leads to both an inlet 56 on a degas bottle 58 and an inlet 60 on a radiator 62. An outlet 64 on the degas bottle 58 and an outlet 66 on the radiator 62 connect to the inlet 40 to the water pump 42.

An electric motor 70 is connected to and drives an input shaft 72 of an engine fan 74. This motor 70 is electrically connected to and driven by a control module 76. The electrical connections between components are illustrated in FIG. 1 by dashed lines. The Control module 76 also electrically connects to and controls the position of the valve 20. A second electric motor 78 connects to an input shaft 80 of the water pump 42. This second motor 78 is also electrically connected to and driven by the control module 76. The control module 76 is electrically connected to the cooling circuit 12 and engine 10 in order to monitor and control the engine cooling process. The control module 76 communicates with various subsystems and sensors on the engine 10 through various electrical connections 82, such as an ambient temperature sensor 84, a coolant temperature sensor 86, an engine speed monitor 88, and an engine load demand monitor 90. While the engine fan 74 and the water pump 42 are illustrated as being driven by electric motors, either one or both may also be driven in a more conventional fashion, such as a pulley and belt assembly or a gear set connected to the engine crankshaft.

FIGS. 2–3 illustrate the operation logic of the system of FIG. 1. For FIGS. 2 and 3, the term "cold" in the table for the coolant indicates a temperature that is below the desired operating level, while "hot" indicates a coolant temperature that is above the desired operating level. The term "cold" for ambient air temperature means a temperature that is below the vehicle occupant's set temperature, and the term "hot" means a temperature that is above the occupant's set temperature. The term "low" for engine speed indicates an engine speed (typically measured in revolutions per minute (RPM)) that is less than a predetermined engine speed, while the term "high" for engine speed indicates an engine speed that is greater than this predetermined engine speed. The term "low" for engine load indicates an engine load demand (typically measured by the throttle position) that is less than a predetermined engine load demand, while the term "high" for engine load indicates an engine load demand that is greater than this predetermined engine load demand. The particular predetermined engine speed threshold and predetermined engine load threshold may be different depending upon the particular engine/vehicle combination being employed.

The operating conditions—ambient temperature, coolant temperature, engine speed, and engine load—can all be determined by sensors on or associated with the engine 10 and communicated to the control module 76. The control module 76 will then use the particular operating conditions to determine the valve position needed for the desired coolant flow through the various components. The control module 76 communicates with the valve 20 to cause it to move to the desired position.

The component flows are illustrated in FIG. 2 that correspond to the operating conditions. While the component flows shown in the tables of FIGS. 2 and 3 are shown as two state—either on or off—the valve 20 can of course be adjusted to allow for partial flows. So the term "off" means little or no coolant flow through that particular component, while the term "on" means the valve is mostly or fully open to allow coolant flow through that particular component.

The multi-port valve preferably has six modes—that is, six different positions that will control whether the coolant flows to the radiator, heater and/or oil cooler. FIG. 4 shows the coolant flow paths for the six modes. By having these six modes, the control module 76 can transition from the current mode to a new desired mode, when one or more of the operating conditions changes. Mode 1 represents a valve position where coolant will generally flow through the heater 36 and oil cooler 48, but not the radiator 62. Mode 2 represents a valve position where coolant will generally flow through the heater 36, but not through the radiator 62 or oil cooler 48. Mode 3 represents a valve position where coolant will generally flow through the heater 36, oil cooler 48 and the radiator 62. Mode 4 represents a valve position where coolant will generally flow through the radiator 62 and the oil cooler 48, but not the heater 36. Mode 5 represents a valve position where coolant will generally flow through the oil cooler 48, but not the radiator 62 or the heater 36. And finally, mode 6 represents a valve position where coolant will generally be blocked from flowing through the radiator 62, the heater 36, and the oil cooler 48.

Figure 5:
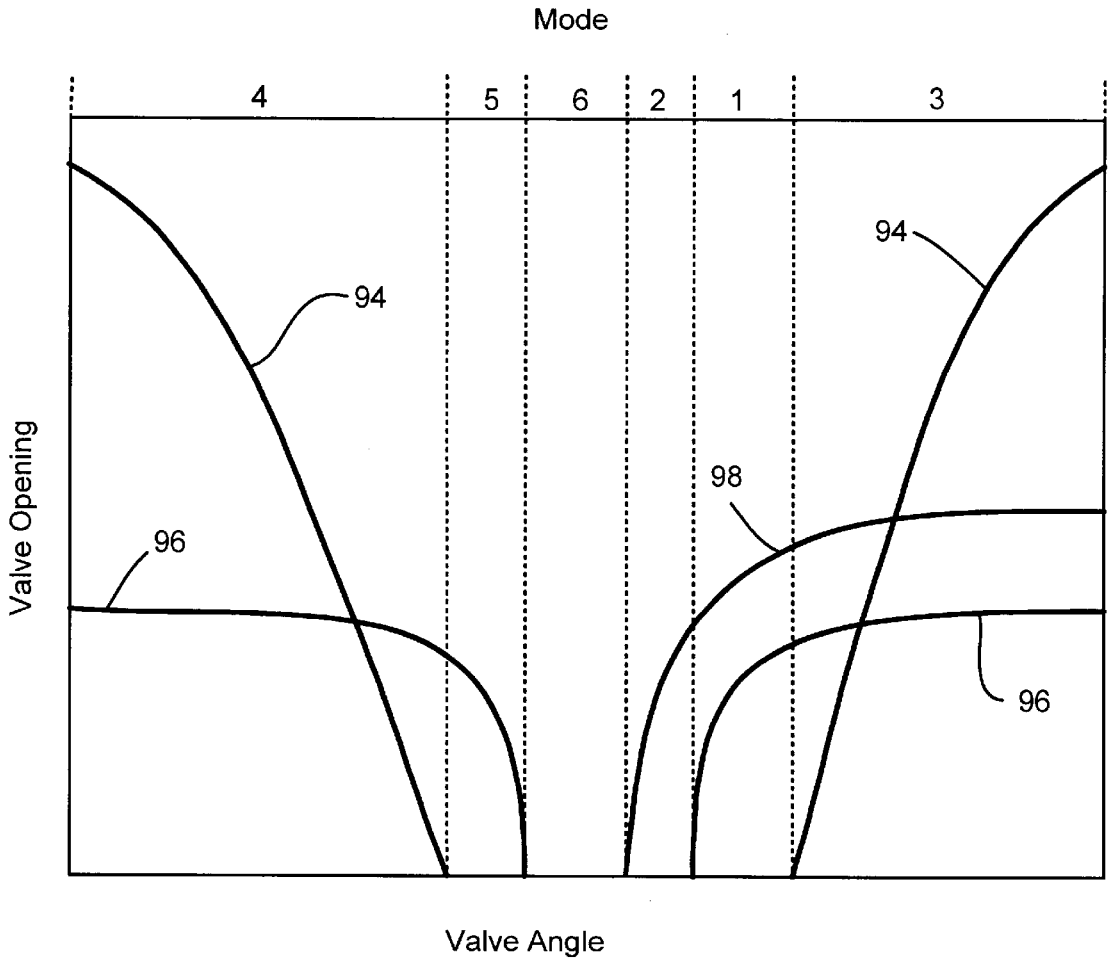
FIG. 5 is a graphic illustration of the valve port opening characteristics and order of the valve modes for a multi-port valve employed in accordance with the present invention.

FIG. 5 is a graph illustrating the preferred arrangement of the valve modes about the valve 20 in order to smoothly transition from one mode to other modes, depending upon changing engine operating conditions. The amount of valve opening for coolant flow to a particular component is illustrated on the vertical axis while the valve angle is illustrated on the horizontal axis. Also, the particular mode that the valve 20 is in based upon the valve angle is noted on the horizontal axis as well. Line 94 represents the valve opening to the second valve outlet (see FIG. 1) for coolant flow through the radiator 62, line 96 represents the valve opening to the second valve inlet 52 for coolant flow through the oil cooler 48, and line 98 represents the valve opening to the first valve outlet 26 for coolant flow through the heater 36.

FIG. 2 illustrates the operational logic of the engine cooling circuit 12 after the diesel engine 10 is warmed up. For most of the 8 different combinations of operating conditions shown, there is one valve mode (and hence the coolant routing) corresponding to the particular set of operating conditions. But for two sets of operating conditions, there are two valve modes each. For the operating condition where the ambient and coolant temperatures are cold, while the engine speed and load are low, the initial preferred valve position is mode 2 since the radiator is not needed to draw heat from the coolant, but the heater is needed to heat the passenger compartment. In this initial mode, the oil cooler is off, but after a preset time or when the oil reaches a predetermined temperature, the control module 76 will signal the valve 20 to switch into a mode 1 position, which will allow for coolant flow through the oil cooler 48 while still blocking flow through the radiator 62. Also, for the operating condition where the ambient temperature is cold, the coolant temperature is hot, and the engine speed and load are low, the initial preferred valve position is mode 3, so that the coolant will flow through the radiator to be cooled. But with a cold ambient temperature and if the engine speed and load remain low, it may be that the coolant temperature drops sufficiently that the coolant will not need to be cooled further by the radiator. The control module 76 will then signal the valve 20 to switch to mode 1, which will block flow through the radiator. As stated above, the valve can also be moved within a mode to increase or decrease slightly the flow through a particular coolant circuit element in order to more precisely manage the thermal characteristics of the engine.

Moreover, in addition to the control module 76 adjusting the valve 20, the control module may also vary the speed of the water pump 42 and the engine fan 70 (if equipped with other than conventional crankshaft driven components) in order to more precisely manage the thermal characteristics of the diesel engine operation.

FIG. 3 illustrates the operational logic of the engine cooling circuit 12 before the engine has warmed up. In this table the operating conditions where oil warming may be needed are considered. Under these operating conditions, when oil warming is needed, the valve 20 is set to a mode where there will be coolant flow through the oil cooler 48, but not flow through the radiator 62. While if no oil warming is needed, then the coolant flow is blocked through both the radiator 62 and the oil cooler 48.

While certain embodiments of the present invention have been described in detail, those familiar with the art to which this invention relates will recognize various alternative designs and embodiments for practicing the invention as defined by the following claims.

What is claimed is:

1. A cooling system for a diesel engine, having a coolant inlet and a coolant outlet, in a vehicle, the cooling system comprising:

a coolant circuit adapted to operatively engage the coolant inlet and coolant outlet;

a pump operatively engaging the coolant circuit to pump a coolant therethrough;

a radiator operatively engaging the coolant circuit;

an oil cooler operatively engaging the coolant circuit;

a heater operatively engaging the coolant circuit;

a valve having a first valve port adapted for receiving coolant from the engine, a second valve port for selectively receiving coolant from the oil cooler, a third valve port for selectively routing coolant to the radiator, and a fourth valve port for selectively routing coolant to the heater, and with the valve being controllable to selectively control the routing of the coolant through the valve ports; and a control module electrically coupled to the valve for electronically controlling the valve to thereby control the routing of the coolant through the valve ports.

2. The cooling system of claim 1 further including a degas bottle having an inlet operatively engaging the third valve port, and an outlet operatively engaging an inlet on the pump.

3. The cooling system of claim 2 further including an EGR cooler having an inlet adapted to operatively engage the coolant outlet of the engine, and an outlet operatively engaging an inlet on the pump.

4. The cooling system of claim 3 further including an engine fan located adjacent to the radiator, and a fan motor drivingly coupled to the fan, and with the fan motor electrically coupled to the control module and controlled thereby.

5. The cooling system of claim 4 further including a pump motor drivingly coupled to the pump, and with the pump motor electrically coupled to the control module and controlled thereby.

6. The cooling system of claim 1 further including an EGR cooler having an inlet adapted to operatively engage the coolant outlet of the engine, and an outlet operatively engaging an inlet on the pump.

7. The cooling system of claim 1 further including an engine fan located adjacent to the radiator, and a fan motor drivingly coupled to the fan, and with the fan motor electrically coupled to the control module and controlled thereby.

8. The cooling system of claim 1 further including a pump motor drivingly coupled to the pump, and with the pump motor electrically coupled to the control module and controlled thereby.

9. The cooling system of claim 1 further including a plurality of sensors adapted to detect operating conditions of the diesel engine, and with the sensors in communication with the control module.

10. The cooling system of claim 1 wherein the valve has a mode wherein the third valve port is substantially prevented from routing coolant to the radiator, the fourth valve port is substantially open to route coolant to the heater and the second valve port is substantially open to receive coolant from the oil cooler.

11. The cooling system of claim 1 wherein the valve has a mode wherein the third valve port is substantially prevented from routing coolant to the radiator, the fourth valve port is substantially open to route coolant to the heater and the second valve port is substantially prevented from receiving coolant from the oil cooler.

12. The cooling system of claim 1 wherein the valve has a mode wherein the third valve port is substantially open to route coolant to the radiator, the fourth valve port is substantially open to route coolant to the heater and the second valve port is substantially open to receive coolant from the oil cooler.

13. The cooling system of claim 1 wherein the valve has a mode wherein the third valve port is substantially open to route coolant to the radiator, the fourth valve port is substantially prevented from routing coolant to the heater and the second valve port is substantially open to receive coolant from the oil cooler.

14. The cooling system of claim 1 wherein the valve has a mode wherein the third valve port is substantially prevented from routing coolant to the radiator, the fourth valve port is substantially prevented from routing coolant to the heater and the second valve port is substantially open to receive coolant from the oil cooler.

15. The cooling system of claim 1 wherein the valve has a mode wherein the third valve port is substantially prevented from routing coolant to the radiator, the fourth valve port is substantially prevented from routing coolant to the heater and the second valve port is substantially open to receive coolant from the oil cooler.

16. The cooling system of claim 1 wherein the valve has a first mode wherein the third valve port is substantially prevented from routing coolant to the radiator, the fourth valve port is substantially open to route coolant to the heater and the second valve port is substantially open to receive coolant from the oil cooler; a second mode wherein the third valve port is substantially prevented from routing coolant to the radiator, the fourth valve port is substantially open to route coolant to the heater and the second valve port is substantially prevented from receiving coolant from the oil cooler; a third mode wherein the third valve port is substantially open to route coolant to the radiator, the fourth valve port is substantially open to route coolant to the heater and the second valve port is substantially open to receive coolant from the oil cooler; a fourth mode wherein the third valve port is substantially open to route coolant to the radiator, the fourth valve port is substantially prevented from routing coolant to the heater and the second valve port is substantially open to receive coolant from the oil cooler; a fifth mode wherein the third valve port is substantially prevented from routing coolant to the radiator, the fourth valve port is substantially prevented from routing coolant to the heater and the second valve port is substantially open to receive coolant from the oil cooler; and a sixth mode wherein the third valve port is substantially prevented from routing coolant to the radiator, the fourth valve port is substantially prevented from routing coolant to the heater and the second valve port is substantially open to receive coolant from the oil cooler.

17. The cooling system of claim 16 wherein the valve is switchable between the valve modes about the valve in the order fourth mode, fifth mode, sixth mode, second mode, first mode, third mode, and fourth mode.

18. A method of controlling an engine temperature of a diesel engine in a vehicle, with the diesel engine having a coolant circuit including a water pump, a flow control valve, and a radiator, an oil cooler, and a heater each operatively connected to the flow control valve, the method comprising the steps of:

detecting a plurality of operating conditions;

determining if the operating conditions are within a first mode, a second mode, a third mode, a fourth mode, a fifth mode, or a sixth mode of operation;

adjusting the flow control valve to substantially prevent routing of coolant through the radiator and allow for routing of coolant through the heater and the oil cooler if the operating conditions are in the first mode;

adjusting the flow control valve to substantially prevent routing of coolant through the radiator and the oil cooler and allow for routing of coolant through the heater if the operating conditions are in the second mode;

adjusting the flow control valve to allow for routing of coolant through the radiator, the heater and the oil cooler if the operating conditions are in the third mode;

adjusting the flow control valve to substantially prevent routing of coolant through the heater and allow for routing of coolant through the radiator and the oil cooler if the operating conditions are in the fourth mode;

adjusting the flow control valve to substantially prevent routing of coolant through the radiator and the heater and allow for routing of coolant through the oil cooler if the operating conditions are in the fifth mode; and adjusting the flow control valve to substantially prevent routing of coolant through the radiator, the heater and the oil cooler if the operating conditions are in the sixth mode.

19. The method of claim 18 further including the step of routing coolant from the water pump through an EGR cooler and back to the water pump.

20. The method of claim 18 wherein the speed of the water pump is controlled based on the detected operating conditions.

* * * * *